United States Patent [19]

Jenkins

[11] Patent Number: 5,006,971

[45] Date of Patent: Apr. 9, 1991

[54] LOW POWER SAFETY FLASHER

[76] Inventor: Lloyd T. Jenkins, 3540 Alipha Pl., Pensacola, Fla. 32503

[21] Appl. No.: 556,669

[22] Filed: Jul. 23, 1990

[51] Int. Cl.[5] ..... F21L 15/02

[52] U.S. Cl. ..... 362/252; 362/246; 362/249; 362/800; 362/103

[58] Field of Search ..... 362/800, 108, 249, 335, 362/340, 252, 103, 184, 186, 191, 200, 208, 311, 205, 225, 295, 230, 235, 251

[56] References Cited

U.S. PATENT DOCUMENTS

| | | | |
|---|---|---|---|
| 4,309,741 | 1/1982 | Smith | 362/800 |
| 4,630,183 | 12/1986 | Fujita | 362/311 |
| 4,727,289 | 2/1988 | Uchida | 362/800 |
| 4,866,580 | 9/1989 | Blackerly | 362/191 |

FOREIGN PATENT DOCUMENTS

| | | | |
|---|---|---|---|
| 54746 | 4/1934 | Netherlands | 362/186 |
| 878534 | 10/1961 | United Kingdom | 362/235 |

*Primary Examiner*—Ira S. Lazarus
*Assistant Examiner*—Y. Quach
*Attorney, Agent, or Firm*—Kelly O. Corley

[57] ABSTRACT

A miniature strobe-type flashing safety light source, to be worn by a person or pet after dark. A plurality of high-intensity LED's producing a total of at least 6 candelas when energized are surrounded by a striated refracting lens, the axes of the intense light cones being oriented between 20 and 40 degrees above the horizontal plane and impinging on the striations. The LED's are periodically and simultaneously energized.

4 Claims, 1 Drawing Sheet

LOW POWER SAFETY FLASHER

The invention relates to the art of safety flashers, and more particularly to the art of miniature low power, strobe-type high intensity light flashers to be worn by a person or pet, in order to render the wearer visible after dark.

It is conventional to provide for high intensity flashing stroboscopic (strobe) lights by using xenon flash tubes. However, such devices are typically comparatively large and heavy, and require a power supply of 100–500 volts. This presents a safety hazard and severely limits their usefulness.

A number of references suggest the use of flashing lights as a safety device to be worn by a person. Many disclose use of an incandescent bulb as the light source, such as Cuckale U.S. Pat. No. 3,840,853, Chao U.S. Pat. No. 3,944,803, Benoit U.S. Pat. No. 4,319,309, Leon U.S. Pat. No. 4,438,482, and Montgomery U.S. Pat. No. 4,535,392. Such devices have the disadvantage of limited light output and high current consumption, providing for expensive operation.

Another group of references use one or more light emitting diodes (LED's), as typified by Kirkley U.S. Pat. No. 4,451,871, and Stephens U.S. Pat. No. 4,599,682. Stephens provides three LED's, with a separate convex reflective surface surrounding each individual LED, in an apparent effort to provide visibility in more than one direction. Kirkley provides a single LED. feeding light through "one or more lens members". The Kirkley device could be clearly seen from a relatively narrow field of view. Each of these two references depends on movement by the wearer for the flashing operation, so that if the wearer were motionless, the flashing would stop.

These and other disadvantages of the prior art practices are avoided by the present invention, which provides a miniature low power strobe-type high intensity flashing light source which is clearly visible throughout 360 degrees.

According to a first principal aspect of the invention, there is provided a low-power light-weight strobe-type light source, the source comprising a plurality of high-intensity separate LED's, the LED's producing when energized a total of at least 6 candelas, each separate LED producing when energized an intense central cone of light directed along an axis individual to the separate LED, the axes being oriented between 10 and 40 degrees (preferably between 20 and 30 degrees) above the horizontal plane. A refracting lens having a perimeter is provided, the lens surrounding and covering the plurality of LED's, the lens comprising a plurality of refracting striations about the perimeter, the LED's and the striations being positioned and oriented such that the striations intercept and scatter the intense central cones of light whereby the light source may be readily seen by observers 360 degrees around the light source. Electronic power supply means periodically and simultaneously energize the plurality of LED's.

According to another aspect of the invention, the LED's are spaced and oriented such that the intense cones of light impinge on the striations at locations substantially equally spaced about the perimeter.

According to another aspect of the invention, there are three LED's oriented such that the axes lie in vertical planes spaced substantially 120 degrees apart. These and other aspects of the invention will in part be disclosed below and will in part be apparent from the following detailed description taken together with the accompanying drawings, wherein.

Figure 1:
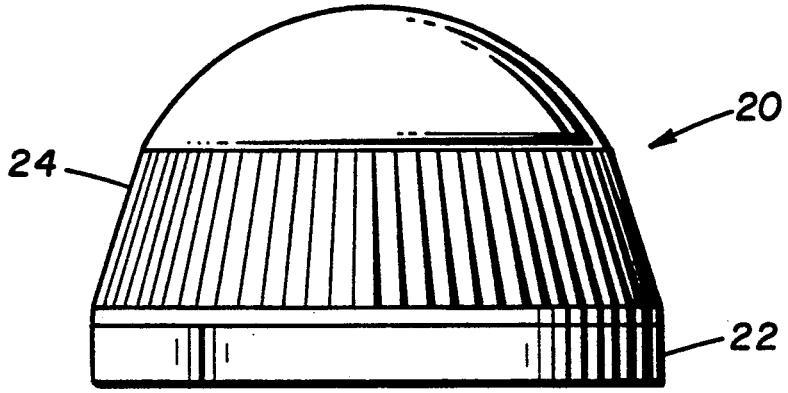
FIG. 1 is a side elevation view of the preferred embodiment of the invention.
Figure 2:
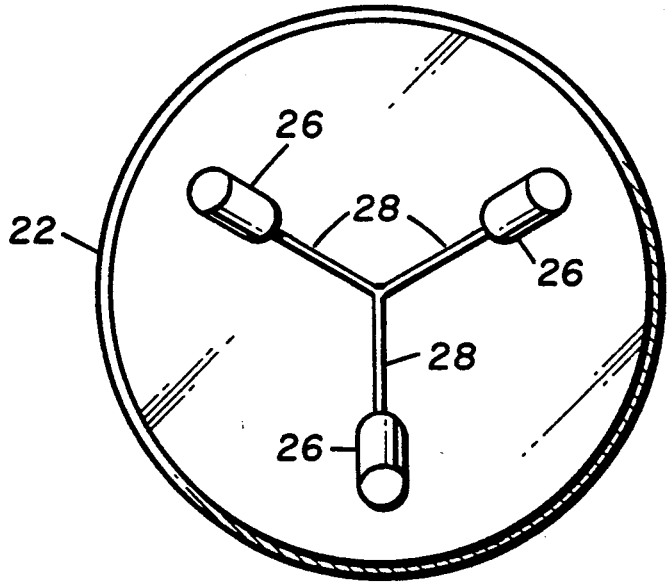
FIG. 2 is a schematic top plan view of the FIG. 1 embodiment with the lens removed, illustrating the preferred orientation of the LED's as viewed from above.
Figure 3:
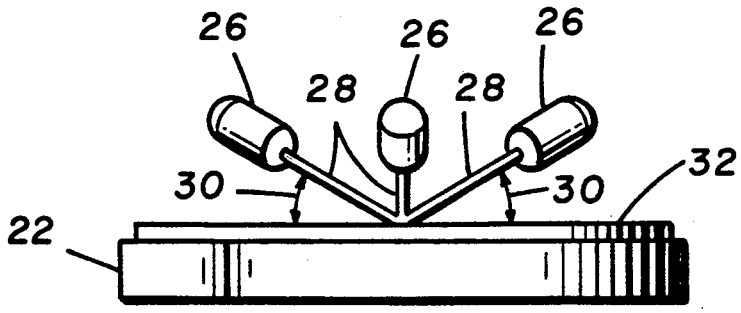
FIG. 3 is a schematic side elevation view of the FIG. 1 embodiment with the lens removed, illustrating the elevation of the LED's axes above the horizontal plane.

As shown in FIGS. 1–3, the preferred embodiment of safety flasher 20 includes a base 22 and striated lens 24 mounted thereon. LED's 26 are mounted on base 22 within lens 24, and are oriented as will be described below.

LED's 26 are of the type producing at least 2 candelas each upon energization, such as Radio Shack #276087. The emitted light is concentrated in a narrow central cone having an apex angle of about 7 degrees, the central cone being surrounded by a somewhat less intense halo extending out at a cone apex angle of about 20 degrees.

By way of comparison, a low voltage (100 volts) xenon strobe produces about 10 candelas. Three LED's 26 of the present invention, producing a total of 6 candelas, approach the light output of such a strobe, but without the safety hazard and at a fraction of the size, weight and power consumption.

It has been discovered that, when worn by small children or pets, maximum visibility is obtained when the LED's are mounted with the axes 28 of their intense central cones of light forming angles 30 of between 10 and 40 degrees (preferably between 20 and 30 degrees) above the horizontal plane 32, as illustrated in FIG. 3. The light thus travels in a partial upward direction while impinging on striations 32 on lens 24, which intercept and scatter the light. If three such LED's are oriented such that their axes lie in vertical planes spaced substantially equally from one another, light source 20 can be seen readily by observers 360 degrees around the light source.

The LED's are periodically energized by conventional circuitry (not illustrated), preferably by a monolithic oscillator such as the type 3909, the timing capacitor being selected in conjunction with the supply voltage to control the rate of flashing. When the supply voltage is 3 volts and the timing capacitor is a 220 microfarad electrolytic capacitor, the frequency of flashing is about 1.5–2 flashes per second, as is preferred. Using two N type batteries to provide the supply voltage gives a service life of over 650 hours. Accordingly, the strobe-type device of the present invention can be quite small and light in weight.

I claim:

1. A low-power light-weight flashing light source, said source comprising:

a. a plurality of high-intensity separate LED's, said LED's producing when energized a total of at least 6 candelas, each said separate LED producing when energized an intense central cone of light directed along an axis individual to said separate LED, said axes being oriented between 20 and 40 degrees above the horizontal plane;

b. a refracting lens having a perimeter, said lens surrounding and covering said plurality of LED's, said lens comprising a plurality of refracting striations about said perimeter, said LED's and said striations being positioned and oriented such that said striations intercept and scatter said intense central cones of light whereby said light source may be readily seen by observers 360 degrees around said light source; and c. electronic power supply means for periodically and simultaneously energizing said plurality of LED's.

2. The light source defined in claim 1, wherein said LED's are spaced and oriented such that said intense cones of light impinge on said striations at locations substantially equally spaced about said perimeter.

3. The light source defined in claim 2, wherein there are three LED's oriented such that said axes lie in vertical planes spaced substantially 120 degrees apart.

4. The light source defined in claim 1, wherein said axes are oriented between 20 and 30 degrees above the horizontal plane.

* * * * *